United States Patent [19]

Daly

[11] 4,027,436

[45] June 7, 1977

[54] EXPLOSION VENTING WALL STRUCTURE WITH RELEASABLE FASTENER MEANS

[75] Inventor: Edwin A. Daly, Southfield, Mich.

[73] Assignee: Walcon Corporation, Ecorse, Mich.

[22] Filed: Mar. 15, 1976

[21] Appl. No.: 666,926

[52] U.S. Cl. ..... 52/1; 49/141; 52/98

[51] Int. Cl.[2] ..... E04H 9/02; E04H 9/14

[58] Field of Search ..... 403/406, 2, 21, 22; 151/44; 285/2; 52/98–100, 1, 682, 701; 49/141

[56] References Cited

UNITED STATES PATENTS

| | | | |
|---|---|---|---|
| 1,473,910 | 11/1923 | Lambert | 285/2 |
| 2,238,945 | 4/1941 | Powell | 52/682 |
| 2,931,471 | 4/1960 | Howard, Jr. | 403/22 |
| 3,157,966 | 11/1964 | Sherburne | 52/701 |
| 3,775,915 | 12/1973 | Chambers et al. | 52/1 |
| 3,807,106 | 4/1974 | Reinhardt | 52/1 |

*Primary Examiner*—Alfred C. Perham

*Attorney, Agent, or Firm*—Robert G. Mentag

[57] ABSTRACT

An explosion venting wall structure incorporating a releasable fastener means. The fastener means comprises a fastener member having a substantially circular body with an opening therethrough, and at least two offset arms extended radially outward from said tubular body. The fastener member circular body is adapted to be disposed in a circular opening in a wall structure, with the offset arms overlapping the opening edge and seated against the wall surface, and with a screw or other retainer means provided for extension through the circular body opening and through said opening in the wall and into securing engagement with a building structural support member. The offset arms are adapted to be folded over or collapsed simultaneously by explosion or windload pressures exerted on the wall structure to permit said circular body with its folded over arms to be passed through said opening in the wall structure and allow the wall structure to be separated from the building structural support member and fall to the ground.

10 Claims, 13 Drawing Figures

FIG. 1
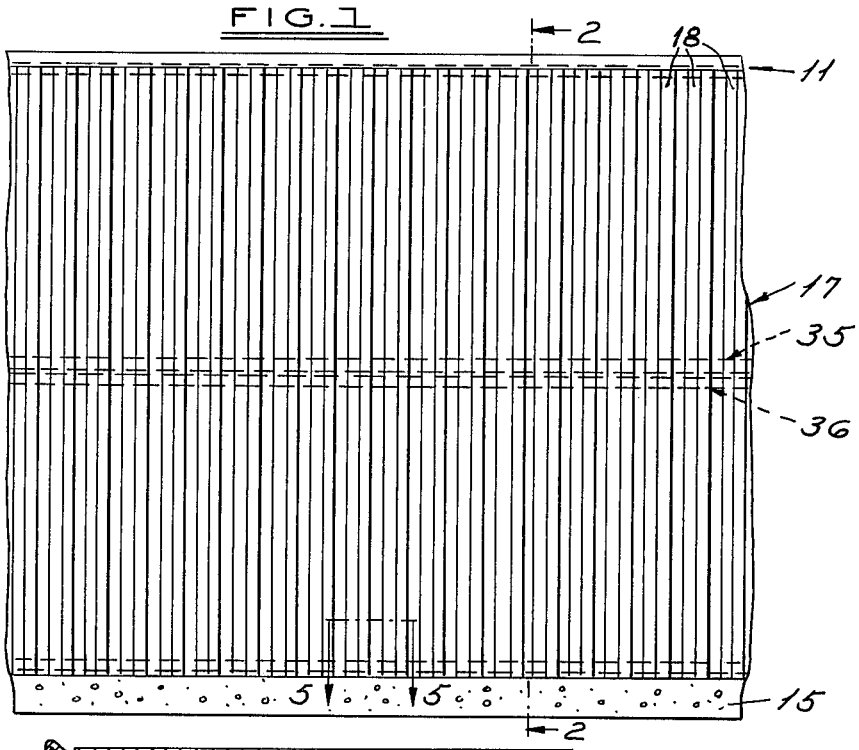
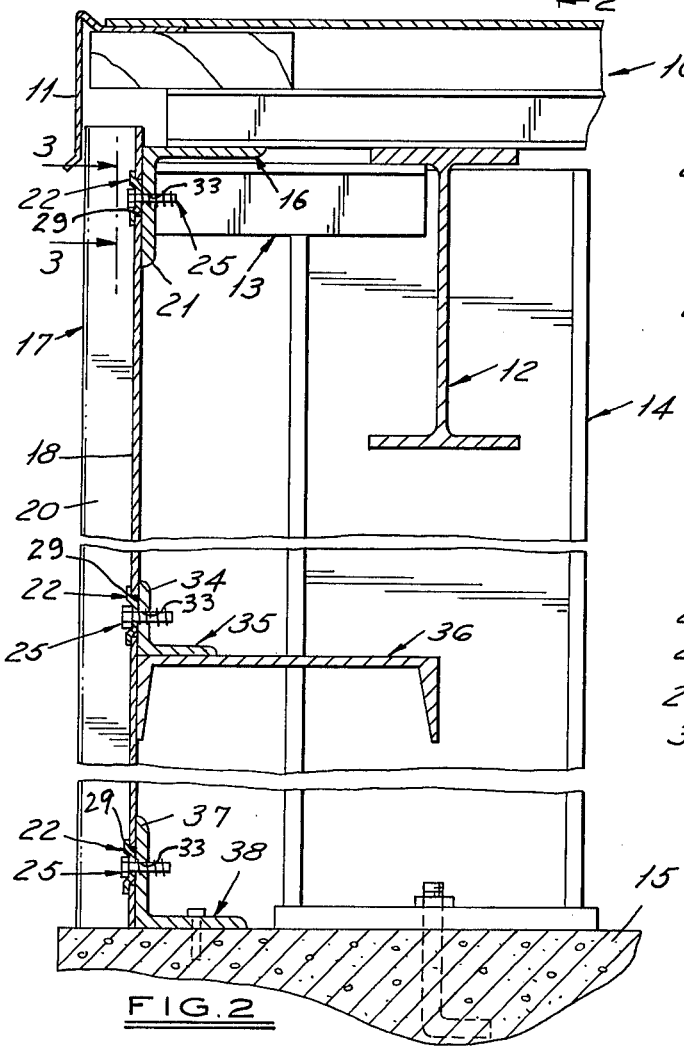
FIG. 2
FIG. 3
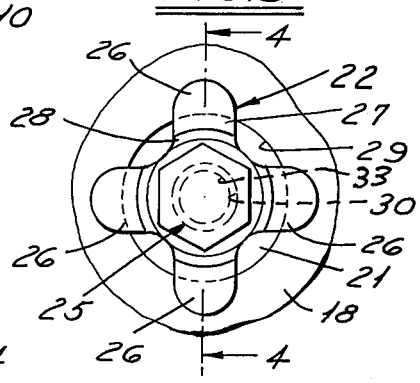
FIG. 4
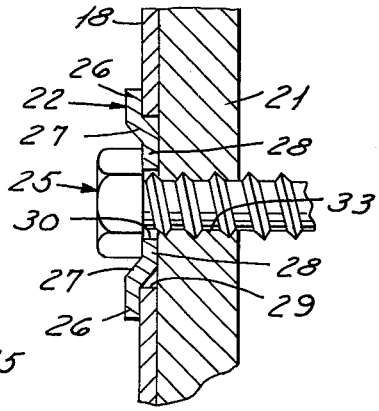

EXPLOSION VENTING WALL STRUCTURE WITH RELEASABLE FASTENER MEANS

SUMMARY OF THE INVENTION

This invention relates to an explosion venting wall structure which is provided with a releasable fastener means, and wherein the wall structure functions as a normal building wall, but it will be opened outwardly in the event of an interior explosion, and it can be constructed to open also inwardly when subjected to high exterior loads or pressures.

Heretofore, explosion venting walls having releasable holding means have been provided, but they have all included certain disadvantageous features. For example, an explosion wall assembly provided with explosion bolts is disclosed in U.S. Pat. No. 3,258,887. A disadvantage of the explosion type bolt disclosed in the above mentioned patent is that they are provided with a reduced diameter shank portion to permit rupture of the same under certain shearing or tension forces. However, the reduced shank portion of the last described explosion type bolt does not have sufficient strength to resist the torque required to tighten the bolt when it is installed so as to properly fasten a wall structure to the rest of the building structure. The reduced shank portion of such a bolt is thus subject to fail in torsion during mounting of a wall in place. Another explosion wall assembly is disclosed in U.S. Pat. No. 3,775,915, and a disadvantage of the wall structure shown in this patent is that it is constructed to swing outwardly upon the occurence of an internal explosion and the bending strength of the hinge structure employed along the upper end thereof to permit such swinging is not accurately determinable. A complete round releasable washer is employed in the last mentioned patent, and the load release value of such a washer releasable fastening means structures is not readily measurable, and it is not possible to obtain consistent pressure release or load release results or values with such structure.

In view of the foregoing, it is an important object of the present invention to provide a novel and improved explosion venting wall structure incorporating a novel and improved releasable fastener means which has consistent and uniform release characteristics.

It is another object of the present invention to provide wall structure for explosion venting of an enclosed area, and for release either inwardly or outwardly at specified positive or negative extreme wind loads caused by the wind load of windstorms, tornados and the like.

It is a further object of the present invention to provide a novel and improved releasable fastener means for releasably securing an explosion venting movable wall structure to a fixed building structure and which comprises a fastener member having a substantially circular body having an opening therethrough, and at least two offset arms extended radially outward from said body, and wherein the offset arms are adapted to be folded over or collapsed by an explosion or wind load exerted on the wall structure, to permit the fastener means to be passed through an opening or hole in the wall structure and allow the wall structure to move inwardly or outwardly in accordance with the positioning of the fastener means.

Other objects, features and advantages of this invention will be apparent from the following detailed description, appended claims and the accompanying drawings.

BRIEF DESCRIPTION OF THE DRAWINGS

FIG. 1 is a fragmentary, outside elevation view of an explosion venting wall structure made in accordance with the principles of the present invention.

FIG. 2 is a fragmentary, broken, enlarged, elevation section view of the explosion venting wall structure illustrated in FIG. 1, taken along the line 2—2 thereof, and looking in the direction of the arrows.

FIG. 3 is a fragmentary, enlarged, elevation view of a releasable fastener means employed in the invention, taken along the line 3—3 of FIG. 2, and looking in the direction of the arrows.

FIG. 4 is a fragmentary, enlarged, elevation section view of the structure illustrated in FIG. 3, taken along the line 4—4 thereof, and looking in the direction of the arrows.

DETAILED DESCRIPTION OF THE PREFERRED EMBODIMENTS OF THE INVENTION

Figure 5:
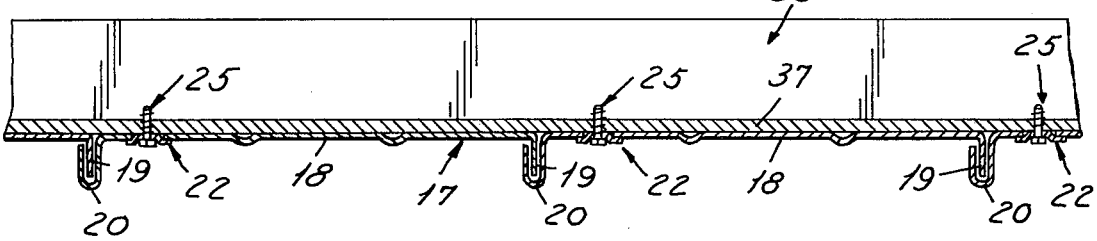
FIG. 5 is a fragmentary, enlarged, horizontal section view of the explosion venting wall structure illustrated in FIG. 1, taken along the line 5—5 thereof, and looking in the direction of the arrows.

Referring now to the drawings, and in particular to FIGS. 1 and 2, wherein an illustrative explosion venting wall is generally indicated by the numeral 17. The wall 17 may be of any desired construction and made from any suitable material. The length and height of the wall panel 17 is also made in accordance with any desired building plan. The numeral 10 generally designates a typical roof construction which includes a metal deck, insulation and roofing material. The numeral 11 generally designates a conventional sheet metal gravel stop which overhangs the upper end of the building wall 17, on the outside thereof. The numeral 12 generally designates a typical structural beam employed in a building construction. The numeral 13 designates a typical structural angle employed in a building construction. The numeral 14 generally designates a typical structural column employed in a building and which is operatively mounted on a building foundation 15. The numeral 16 generally designates a typical building structural angle beam which is employed as a horizontal outrigger member in the building frame.

As shown in FIG. 5, the building wall 17 if formed from a plurality of interconnected vertical panels 18. One edge 19 of each of the panels 18 is bent outward perpendicularly and it is slidably received within a U-shaped edge portion 20 on the next adjacent panel 18. The upper end of the wall 17 is releasably connected to a vertical flange 21 of the horizontal structural angle beam 16 by a plurality of longitudinally spaced fastening means made in accordance with the principles of the present invention.

Figure 6:
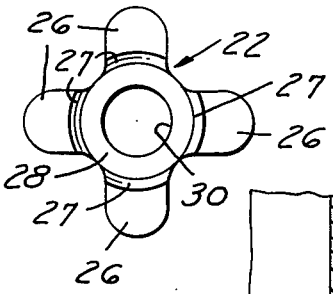
FIG. 6 is a side elevation view of a first embodiment of the releasable fastener means employed in the invention.

As best seen in FIGS. 3 and 4, each of said fastening means includes a collapsible fastener member, generally indicated by the numeral 22, which functions with a suitable retainer means, such as a self-threading metal screw generally indicated by the numeral 25. As illustrated in FIGS. 3 and 6, each of the fastening members 22 includes a central body portion 28 which is substantially circular, and which may also be termed washer-shaped. A circular hole 30 is centrally formed through the fastener body portion 28. As best seen in FIG. 4, the washer-shaped body portion 28 is adapted to be seated within a circular opening 29 formed through the building wall panel 18 and to be seated against the outer face of the horizontal angle beam flange 21. As best seen in FIGS. 3 and 6, the fastener member 22 is provided with four outwardly extended fastening arms which extend radially outward from the washer-shaped body 28, and each of which includes an inner end portion 27 which is integral with the washer-shaped body 28. Each of the arms portion 27 extends outwardly from the flange 21 and is integrally connected to an outer end arm portion 26 which is offset from the body portion 28 and disposed in a plane parallel thereto.

In the embodiment shown in FIGS. 2, 3 and 4, the thickness of each fastener member 22 is preferably made slightly less than the thickness of the panel 18, as clearly shown in FIG. 4 for tightening purposes. Each of the fastener members 22 is centrally disposed within a circular hole 29 formed through the wall panel 18, and it is secured in position as shown in FIG. 4 by a retainer screw 25. Each of the retainer screws 25 is threadably mounted in a bore 33 formed through the structural beam flange 21. The inner ends of the arm portions 27 are arcuate in plan shape, as shown in FIG. 6, and their outer arcuate edges function to locate the fastener member 22 within the hole 29 in the panel 18 during the assembly of the fastening means and for engaging the wall panel for a weight supporting function. The fastener member 22 might also be terned a releasable fastening retainer clip.

The wall 17 is releasably secured by a plurality of longitudinally spaced fastening members 22, as illustrated in FIG. 2. The longitudinally extended structural angle beam, generally indicated by the numeral 35, is operatively mounted on a longitudinal structural channel 36. A plurality of the fastening members 22 are each mounted in openings 29 formed through the wall panels 18, and they are secured by suitable self-threading metal screws 25 to the vertical flange 34 of the structural angle beam 35. As illustrated in FIG. 2, the lower end of the wall 17 is also releasably secured in place by fastening means made in accordance with the invention. As illustrated in FIG. 2, the longitudinal angle beam generally indicated by the numeral 38 is secured to the building foundation 15. The lower ends of the wall panels 18 are each provided with holes 29, in each of which is mounted a fastening member 22 which is secured in place by a self-threading screw 25 which is threadably mounted in a suitable bore 33 in the angle flange 37. It will be understood that other retainer means could be used instead of the screw 25, as for example a bolt and nut. It will also be understood that additional fastening members 22 may also be employed to hold the vertical side edges of the panels 18 in place, if desired. It will also be understood that the wall portion 17 may be provided with conventional sheet metal componenets, such as flashings, closure strips, weatherproofing strips, insulation, and other such elements, as desired.

In use, the releasable fastener members 22 may be made from any suitable material, as for example, from aluminum or steel. The thickness of the fastener members 22 may be selected as required, but the thickness is selected so that the body portion 28 of the releasable fastener members 22 is slightly less than the thickness of the panels 18 so that when the retainer screw 25 is tightened, the collapsible fingers or wings (26, 27) will exert a tightening force on the panels 18. It will be seen that all of the screws 25 can be tightened uniformly in accordance with a predetermined torque so as to provide a uniform tightness in all of the releasable fastener members 22 in a wall structure 17. It will also be seen that the releasable fastener members 22 also function as weight supporting members, since the holes 29 in the panels 18 are engaged by the outward sloping finger inner portions 27. The cross sectional size and length of each of the offset fingers, comprising the portions 26 and 27, can be maintained uniformly for all these members, and the predetermined load value determined accurately at which these offset fingers will all collapse, so as to permit a wall structure to be detached or released with consistency and uniformity. Experience has shown that a plurality of the releasable fastener members 22 function simultaneously to release a wall structure with consistency and uniformity, and with a high degree of predictable release accuracy. It will also be seen that the structure of the collapsible fastener members 22 is such that the collapsible fingers can be designed by varying the thickness of the metal used, and the width of the fingers, so as to provide any desired release value within a wide range of such release values.

Figure 13:
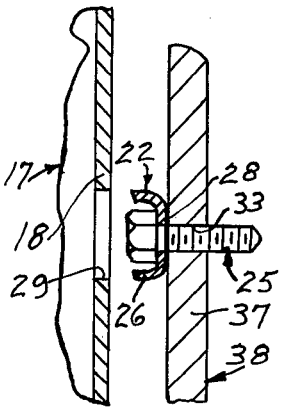
FIG. 13 is a fragmentary, elevation section view of a wall panel, a structural angle, and a releasable retainer fastener means after release from the panel.

It will be seen that when a predetermined internal explosion force occurs within the building structure illustrated in FIG. 2, that the wall structure 17 will be moved outwardly by the action of the fingers 22 being folded over and collapsed to the position shown in FIG. 13, so as to permit each releasable fastener member 22 to pass through its respective hole 29 in a wall panel 18, and permit the wall structure 17 to be moved outwardly from its supporting building structural members and fall away from the building, so as to vent the adjacent enclosed area in the building on which the wall structure 17 is attached.

Figure 7:
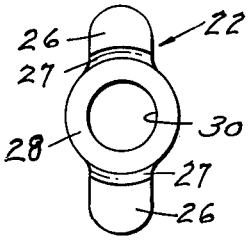
FIG. 7 is a side elevation view of a second embodiment of the releasable fastener means employed in the invention.

FIG. 7 illustrates a modified releasable retainer member 22 which is provided with only two of the collapsible fingers which are formed by the portions 26 and 27. FIG. 7 illustrates the use of two collapsible fingers on a releasable member 22, and FIG. 6 illustrates the use of four collapsible fingers on a releasable fastener member 22. However, it will be understood that the releasable fastener members 22 may also be formed with any suitable plurality of collapsible fingers, as for example, three fingers, five fingers, and so forth, so as to suit special or desired releasable load characteristics.

Figure 8:
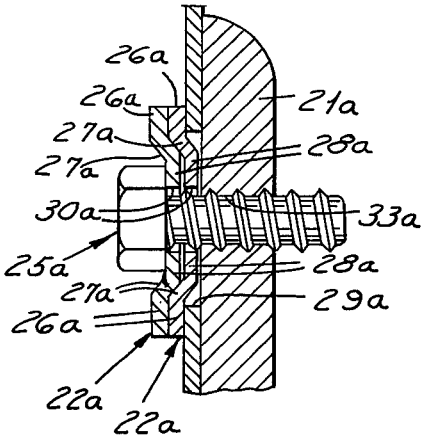
FIG. 8 is an elevation section view, similar to FIG. 4, and showing the use of a pair of releasable fastener means.

FIG. 8 illustrates the use of a pair of releasable fastener members of the type illustrated in FIG. 6. The parts of the illustrated structure shown in FIG. 8 which are the same as parts in the structure illustrated in FIG. 4, have been marked with the same reference numerals, followed by the small letter "*a*." The employment of two stacked, collapsible fastener members, as 22*a* in FIG. 8, would be selected to meet a required wind load or pressure release value. It will also be seen that more than two of the releasable fastener members 22*a* may be employed in a stacked relationship, as required by release load conditions. The employment of a plurality of stacked fastener members 22*a* of a certain standard size eliminates the need for a plurality of different sizes or thicknesses or releasable faster of different sizes or thicknesses of releasable fastener members of this type.

FIGS. 9 through 12 illustrate the employment of the invention in a structural wall arrangement wherein the building side panels are erected for release (blow-in or blow-out), at specified positive or negative extreme wind loads. The parts of the structure illustrated in FIGS. 9 through 12 which are the same as the parts in the structure of FIGS. 1 through 6 have been marked with the same reference numerals followed by the small letter "*b*."

Figure 12:
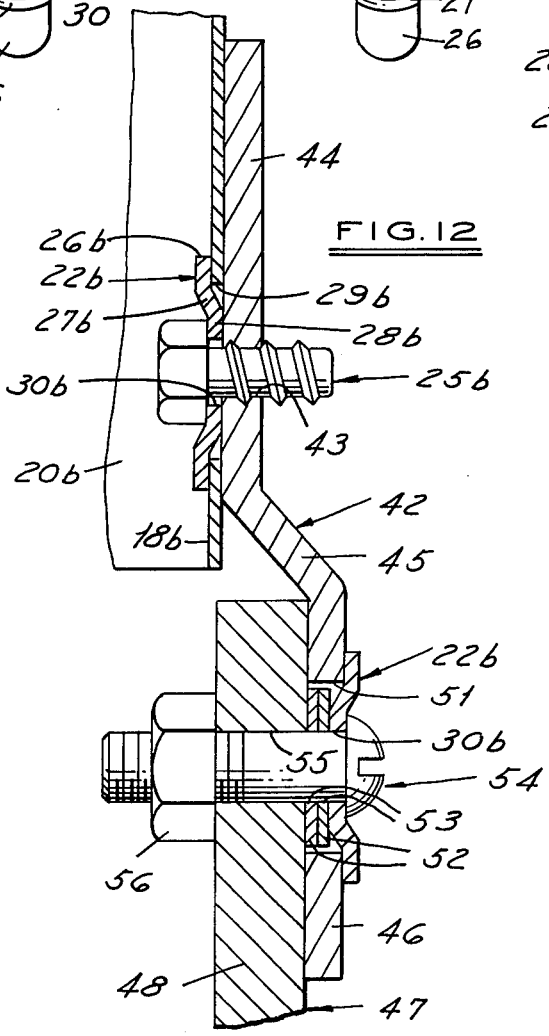
FIG. 12 is a fragmentary, enlarged, elevation section view of the structure shown in FIG. 10, taken within the area marked by the numeral 12 in FIG. 10.
Figure 10:
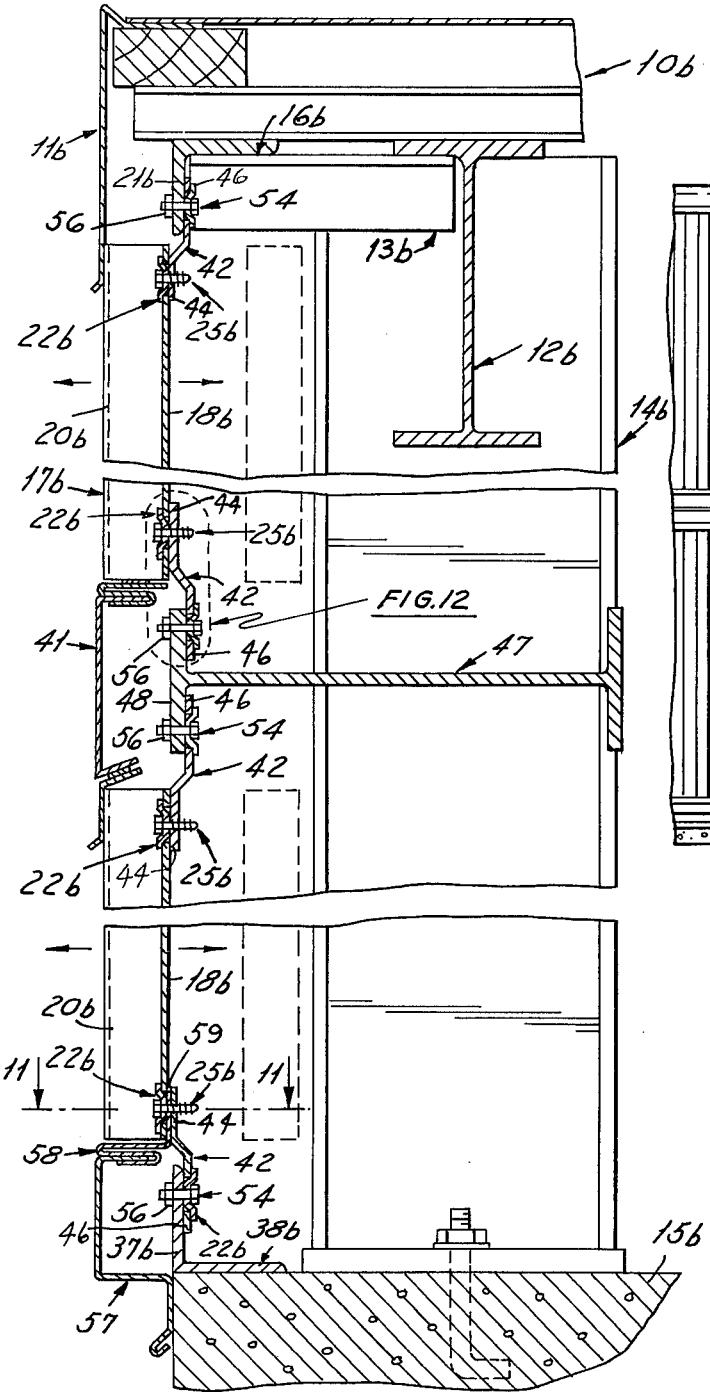
FIG. 10 is a fragmentary, broken, enlarged, elevation section view of the explosion venting wall structure illustrated in FIG. 9, taken along the line 10—10 thereof, and looking in the direction of the arrows.
Figure 9:
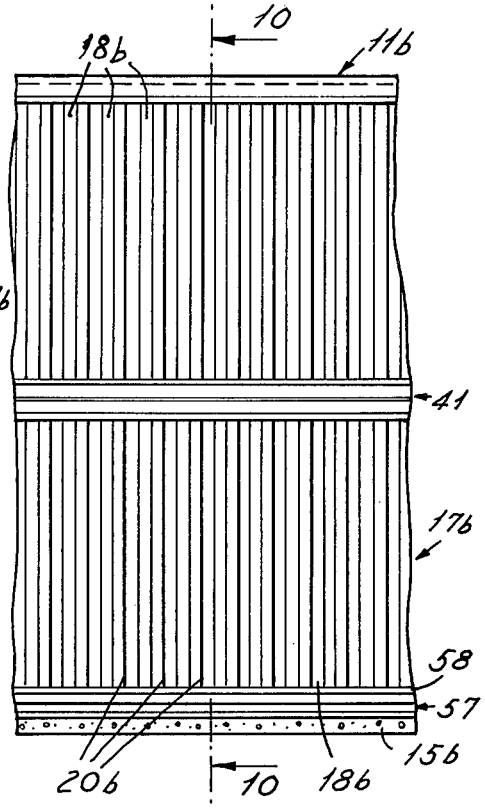
FIG. 9 is a fragmentary, outside elevation view of a second explosion venting wall structure made in accordance with the principles of the present invention.
Figure 11:
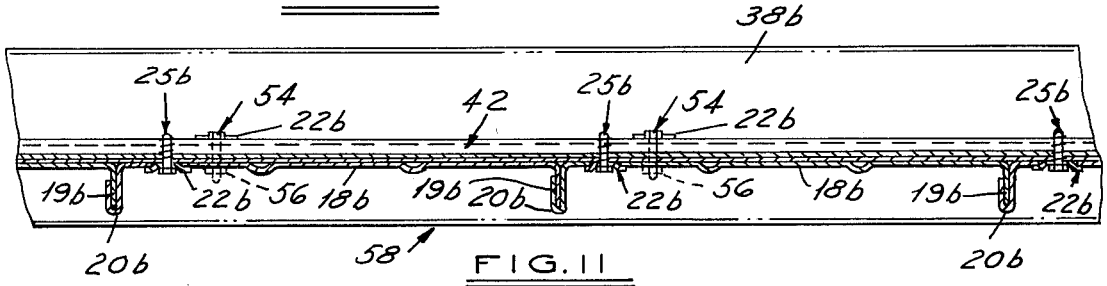
FIG. 11 is a fragmentary, horizontal section view of the structure illustrated in FIG. 10, taken along the line 11—11 thereof, and looking in the direction of the arrows.

FIG. 12 illustrates the Z-shaped panel support member 42 shown within the broken line circled area in FIG. 10 which is identified by the designation "FIG. 12." As shown in FIG. 12, each of the Z-shaped support members 42 is provided with an inner or vertical portion 44, and an outer vertical portion 46 which is offset inwardly and integrally connected to the vertical portion 44 by an angled intermediate portion 45. The outer Z-shaped support portion 44 is releasably attached by the releasable fastener member 22*b* and a retainer screw 25*b* to an upper panel 18*b*, so that the panel 18*b* can be released in an outward direction in the event of an interior explosion. The inner vertical support portion 46 is secured by a releasable fastener member 22*b*, a retainer bolt 54 and a lock nut 56 to a vertical flange 48 of a fixed structural I-beam, generally indicated by the numeral 47.

The releasable fastener member 22*b* is seated in a circular opening 51 formed through the Z-shaped support member vertical portion 46, and it is spaced from the inner surface of the structural support flange 48 by a pair of washers 52 which may be made from any suitable material, as for example, a suitable metal. The size or thickness of the washers 52 is selected in accordance with the thickness of the releasable fastener member 22*b* and the Z-shaped support member portion 46. The retainer bolt 54 extends through the opening 30*b* formed through the releasable fastener member 22*b*, the holes 53 formed through the washers 52, and the hole 55 formed through the structural support flange 48. The bolt 54 is retained in place by the lock nut 56 which is tightened to a predetermined torque.

As shown in FIG. 10, the lower end of the wall panel structure 17*b* has connected thereto a sheet metal flashing, generally indicated by the numeral 57, which extends lengthwise of the wall panel 17*b* so as to cover the structural angle 38*b*. The upper end of the sheet metal flashing 57 is connected to a suitable panel attachment member 58 which has a flange 59 attached to the lowermost Z-shaped support member 42 by a lower row of retainer screws 25*b*. Although the structure of FIG. 12 discloses the washers 52, the washers 52 have been omitted in the reduced size structure illustrated in FIG. 10 because of the reduced size of the various structural parts in FIG. 10, and the lack of space for such washers to be shown. It will be seen that the wall panel structure 17*b* is also secured to the structural member 47 by a second Z-shaped support member 42. It will also be seen that the lower end of the panel 17*b* is connected to the lower structural angle 38 retained by a Z-shaped support member 42, and that the upper end of the panel 17*b* is connected to the structural angle 16*b* by a Z-shaped angle member 42.

In use, it will be seen that the panel 17*b* will be automatically released from a fixed building support structure upon a predetermined interior wind load if an explosion occurs in the interior of the building. The interior wind load pressure will cause all of the releasable fastener members 22*b* attached to the outer support member portions 44 to pass through the holes 30*b* in the panels 18*b* so as to permit the wall section 17*b* to be moved outwardly and dropped from the building. In the event of a predetermined exterior wind load, the releasable fastener members 22*b* attached to the inner support member portions 46 would be operative so that the said last mentioned fastener members 22*b* would collapse and pass through the openings 51 formed in the Z-shaped portions 46 and permit inward movement of the panel 17*b* to a point where such panel would be released from a building structure and dropped to the ground.

While it will be apparent that the preferred embodiments of the invention herein disclosed are well calculated to fulfill the objects above stated, it will be appreciated that this invention is susceptible to modification, variation and change.

What is claimed is:

1. In a building structure, the combination comprising:

a. a fixed building structure having an opening in the exterior of the building;

b. a releasable venting wall panel for enclosing said opening in the fixed building structure and being provided with a plurality of attachment holes;

c. a plurality of releasable fastener means solely attaching said releasable venting wall panel to said fixed building structure and including;

b. a fastener member disposed at each of said holes in said releasable venting wall panel on the exterior side thereof and having arm means extending radially outward and overlapping the exterior edge of the adjacent hole; and, b. retainer means for each of said fastener members extended through the adjacent hole in the releasable venting wall panel and attached to the fixed building structure, whereby when an internal explosion occurs inside the fixed building structure and generates a predetermined force of the releasable wall venting panel, the releasable venting wall paner will be forced outward away from the fixed building structure and the arm means on all of the fastener member will be folded over simultaneously to permit each fastener member to pass through the adjacent hole in the releasable venting wall panel and completely detach the releasable venting wall panel from the fixed building structure.

2. A building wall structure as defined in claim 1, wherein:

a. a plurality of fastener members are disposed at each of said holes in said releasable venting wall panel.

3. A building structure as defined in claim 1, wherein:

a. each of said fastener members includes, a body portion disposed in the adjacent hole in the releasable venting wall panel, and said arm means is integral with the body portion and is offset outwardly so as to overlap the exterior edge of the adjacent hole.

4. A building structure as defined in claim 3, wherein:

a. each of the holes in said releasable venting wall panel is circular;

b. each of said fastener member body portions is circular and is seated in one of said circular holes in the releasable venting wall panel; and, c. each of said arm means includes at least one arm having an offset outer end portion that overlaps the exterior edge of the adjacent hole and an angled inner end portion that connects the outer end arm portion to the body portion.

5. A building structure as defined in claim 4, wherein:

a. the arm means of each of the fastener members include at least two radially outward extended arms.

6. A building structure as defined in claim 5, wherein:

a. each of said angled inner end arm portions has an arcuate termination shape at the point where it is attached to the outer end arm portion, whereby the arcuate shape of each of the inner end arm portions functions to locate each of the fastener member body portions in the adjacent circular hole in the releasable venting wall panel.

7. A building structure as defined in claim 1, including:

a. at least one support member disposed intermediate the releasable venting wall panel and the fixed buidling structure, and said retainer means being attached to said support member for releasably securing said releasable venting wall panel to the support member;

b. said support member being provided with a plurality of attachment holes;

c. another plurality of releasable fastener means attaching said support member to said fixed building structure and including:

1. a fastener member disposed at each of said holes in said support member on the interior side thereof and having arm means extending radially outward and overlapping the interior edge of the adjacent hole; and, 2. a retainer means for each of said last-mentioned fastener members extended through the adjacent hole in the support member and attached to the fixed building structure, whereby when an external windload of a predetermined force is exerted on the releasable venting wall panel, the releasable venting wall will be forced inward and the arm means of the fastener members holding the support member to the fixed building structure will be folded over simultaneously to permit each of the fastener members carrying said last-mentioned arm members to pass through the adjacent hole in the support member and detach the releasable venting wall panel from the fixed building structure.

8. A building structure as defined in claim 7, wherein:

a. each of said another plurality of releasable fastener means includes a body portion disposed in the adjacent hole in said support member, and said arm means is integral with the body portion and is offset inwardly so as to overlap the interior edge of the adjacent hole in the support member.

9. A building structure as defined in claim 8, including:

a. spacer means disposed in each of the holes in the support member on the exterior side of the body portion of each fastener means.

10. A building structure as defined in claim 9, wherein:

a. the arm means of each of the fastener members include at least two radially outward extended arms.

* * * * *

UNITED STATES PATENT OFFICE

CERTIFICATE OF CORRECTION

Patent No. 4,027,436 Dated June 7, 1977

Inventor(s) EDWIN A. DALY

It is certified that error appears in the above-identified patent and that said Letters Patent are hereby corrected as shown below:

Column 1, line 32, "occurence" should be ---occurrence---.
Column 3, line 6, "if" should be ---is---.
Column 5, line 19, delete "or releasable faster".
Column 5, line 20, delete "of different sizes or thicknesses ".

Claim 1, line 60, "of" should be ---on---.
Claim 1, line 62, "paner" should be ---panel---.
Claim 1, line 64, "member" should be ---members---.
Claim 1, line 50, b. should be ---1.---.
Claim 1, line 55, b. should be ---2.---.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*